United States Patent [19]

Sato

[11] 4,355,922

[45] Oct. 26, 1982

[54] METAL CLAMP FOR SCAFFOLDING, TEMPORARY BUILDING AND THE LIKE

[76] Inventor: Masataro Sato, 2-28-26, Fukuoka-machi, Takamatsu-shi, Japan

[21] Appl. No.: 62,234

[22] Filed: Jul. 27, 1979

[30] Foreign Application Priority Data

Feb. 23, 1979 [JP] Japan ..... 54-020342

[51] Int. Cl.[3] ..... F16B 1/00; F16B 7/08; E04G 7/16

[52] U.S. Cl. ..... 403/385; 24/249 LS; 248/229; 403/3; 403/400

[58] Field of Search ..... 24/249 R, 249 LS, 132 WL, 24/81 CC, 279, 285, 248 SA; 403/385, 400, 3; 248/229, 219.4, 226.2

[56] References Cited

U.S. PATENT DOCUMENTS 1,706,801 3/1929 Merrill ..... 403/385

1,918,843 7/1933 Holmes ..... 403/385

2,511,035 6/1950 Barton ..... 403/385

3,810,704 5/1974 Lowe ..... 403/385

FOREIGN PATENT DOCUMENTS 1253041 11/1971 United Kingdom ..... 403/385

*Primary Examiner*—Alexander Grosz

*Attorney, Agent, or Firm*—Browdy and Neimark

[57] ABSTRACT

A clamp for scaffolding and temporary building and similarly acting fittings in which the curvatures of the pipe carrier and the pipe holder forming the clamp for receiving and holding the pipes are determined at a substantially intermediate value among the curvatures of the pipes of different diameters and a bolt embracer provided at the free end of the pipe holder is substantially directed to a radial direction of the circle formed by the pipe carrier and the pipe holder of the clamp, thereby averting the nut from slipping off the bolt embracer and securing a positive clamping effect.

21 Claims, 7 Drawing Figures

METAL CLAMP FOR SCAFFOLDING, TEMPORARY BUILDING AND THE LIKE

TECHNICAL FIELD OF INVENTION

The invention relates to a metal fitting and more particularly to a metal clamp for use in scaffolding, temporary buildings and the like.

BACKGROUND ART

At present, the scaffoldings and the temporary buildings need generally the metal pipes with the metal clamps in place of the logs with the wires.

However, the metal pipes of different diameters need various types of clamps of different sizes and this causes (1) unstable fastening effect with relaxation or disengagement of a fastener when a clamp of different size is applied to a pipe of different diameter with less contacting points between an outer circumference of the pipe and an inner circumference of the clamp (2) increase of the types of the clamp to be applied to the pipes of different diameter with enlargement of the space for storing the clamps of many kinds and (3) inconvenience in the fastening operation of the clamps of different sizes.

SUMMARY OF THE INVENTION

The invention as claimed is intended to provide a remedy. It solves the problem of how to design a clamp for scaffolding and temporary building and similary acting fittings in which the curvatures of the pipe carrier and the pipe holder forming the clamp for receiving and holding the pipes are determined at a substantially intermediate value among the curvatures of the pipes of different diameters and a bolt embracer provided at the free end of the pipe holder is substantially directed to a radial direction of the circle formed by the pipe carrier and the pipe holder of the clamp, thereby averting the nut from slipping off the bolt embracer and securing a positive clamping effect.

The advantages offered by the invention are mainly that the metal clamp may be applied to the pipes of different diameters with convenient fitting operations and the stable clamping effect may be performed.

BRIEF DESCRIPTION OF THE DRAWINGS

One way of carrying out the invention is described in detail below with reference to drawings which illustrate preferred embodiments, in which.

BEST MODE FOR CARRYING OUT THE INVENTION

Figures 1, 7:
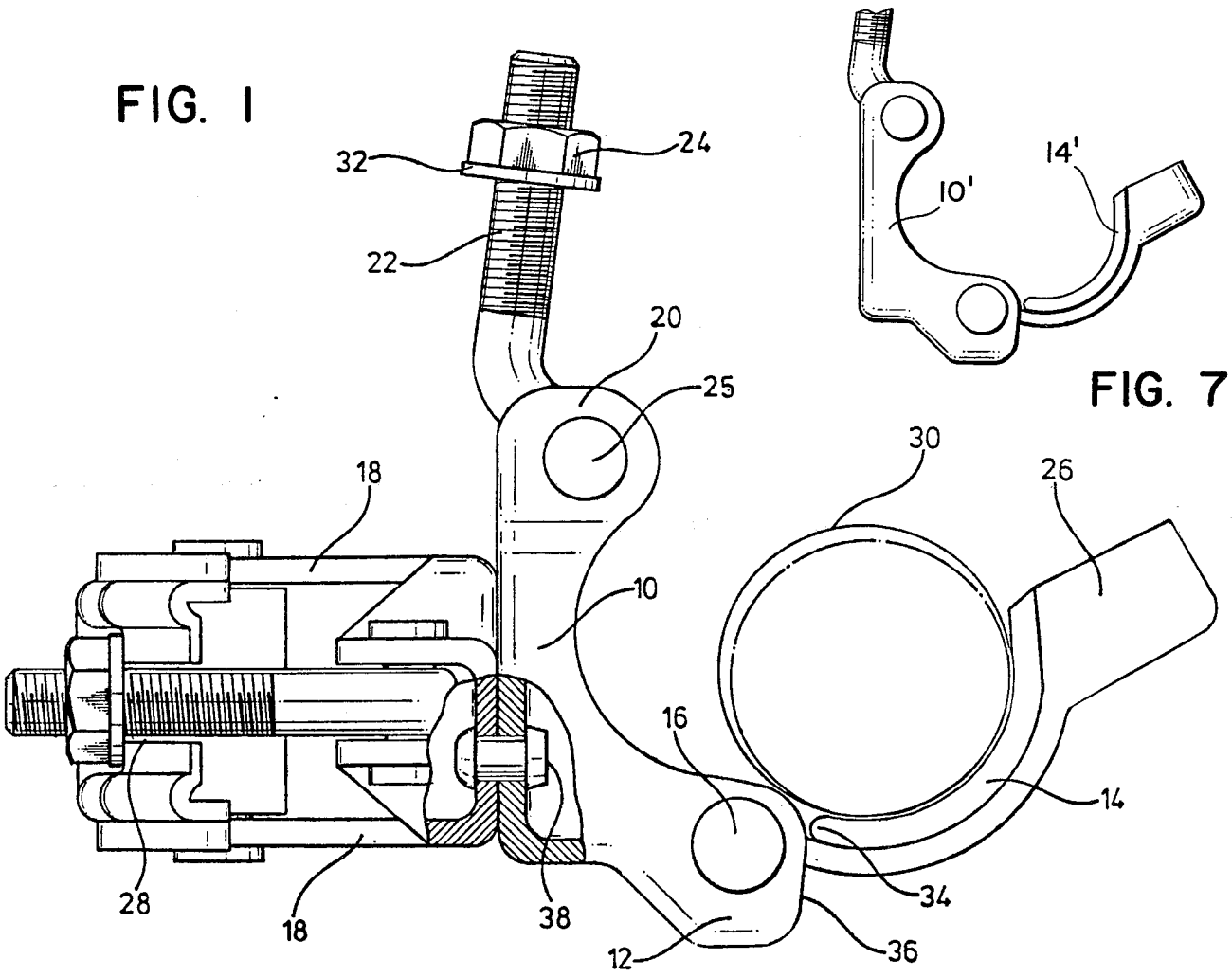
FIG. 1 is a lateral view, partially in section of the metal clamp according to the invention with a movable pipe holder in an opened position and in its attitude of use.
FIG. 7 is a fragmentary view similar to FIG. 1 showing another embodiment of a clamp according to the invention.

The figures show a scaffold clamp comprising in its basic design, a pipe carrier 10 of substantially L-shape having at its one end a yoke 12 to which one end of a pipe holder 14 is pivoted with a pivot pin 16 and at its opposite sides symmetrically upstanding pipe bearing frames 18, 18 with predetermined curvature as hereinafter fully described and the frames 18, 18 are converged at their one end to provide a bracket 20 for movably supporting a bolt 22 with a nut 24 through a pivot pin 25.

The curvatures of the frames 18, 18 are preferably determined at an intermediate value of two or more pipes of different diameters such as 1.680":1.913" or 1.901":2.000", so that a single metal clamp may be applied for two or more pipes of different diameters.

Figure 2:
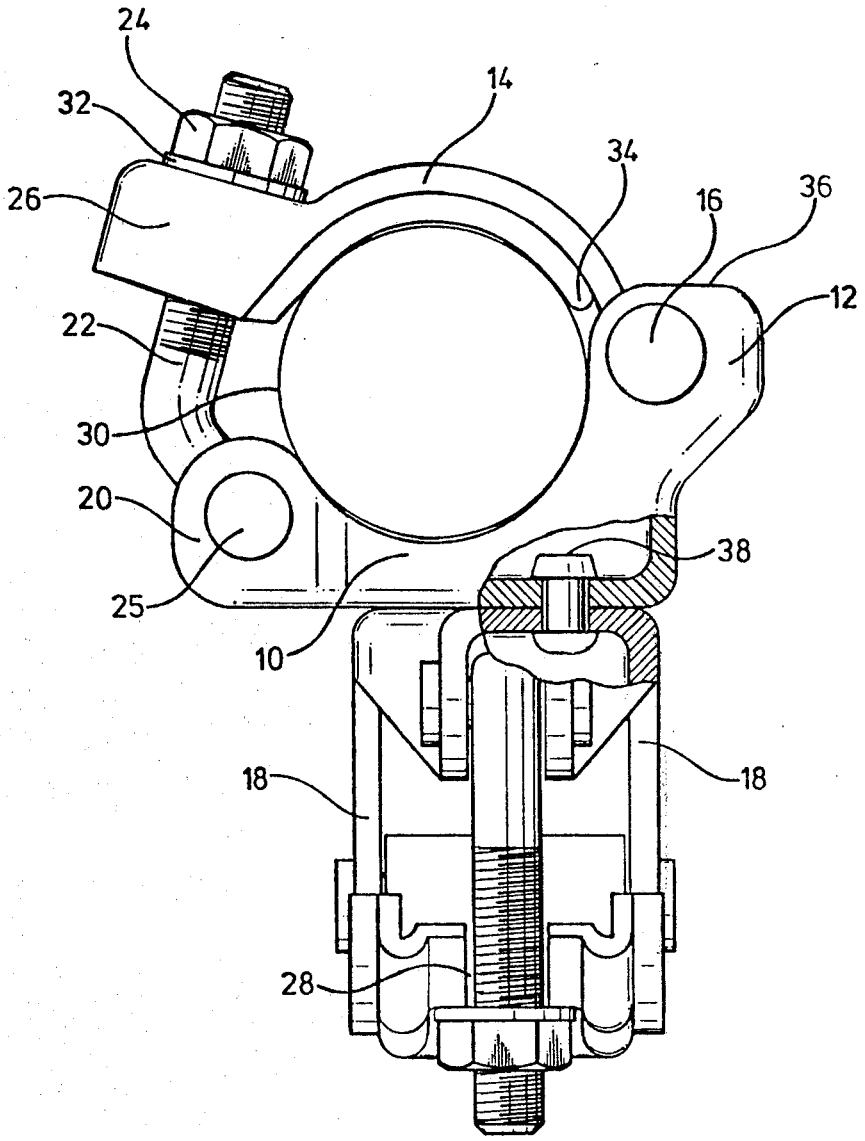
FIG. 2 is a lateral view of the metal clamp holding the pipe therein.

The pipe holder 14 at its free end is provided with an outwardly extended embracer 26 with a recess 28 adapted to receive the bolt 22 when a pipe 30 is clamped as shown in FIG. 2.

The embracer 26 is outwardly extended along the radial direction of the circle formed by the pipe carrier 10 and the pipe holder 14, so that the outer surface of the embracer 26 is closely confronted with a seat 32 of the nut 24 when fastened without causing any undesired clearance therebetween which likely relaxes the fastening power of the fastener.

The pipe holder 14 also has the same curvature as that of the pipe carrier 10. Alternatively, the pipe holder 14 may have the curvature equivalent to the curvature of the pipe of smaller diameter whereas the pipe carrier 10 may have the curvature equivalent to that of the pipe of larger diameter or vice-versa. By this structure at least more than a half of the circumference of the pipe is sufficiently fitted to the clamp with increased contacting points which ensures the increased clamping effect as compared with the case where the size of the clamp circumference is larger or smaller than the diameter of the pipe to be clamped. FIG. 7 shows an embodiment wherein the pipe holder 14' has a lesser curvature of radius than the pipe carrier 10.

Figure 4:
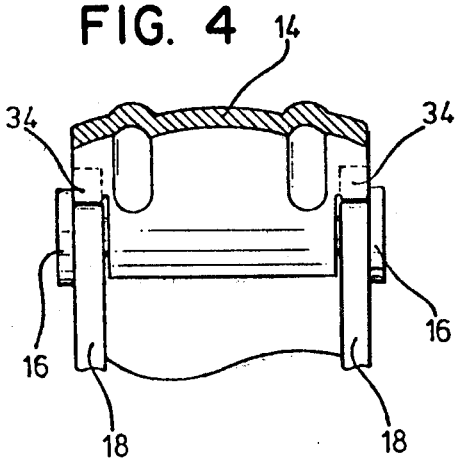
FIG. 4 is a partially enlarged vertical sectional view seen from a plane through the line IV—IV of the pipe holder in the opened position and in engagement with the pipe carrier.
Figure 3:
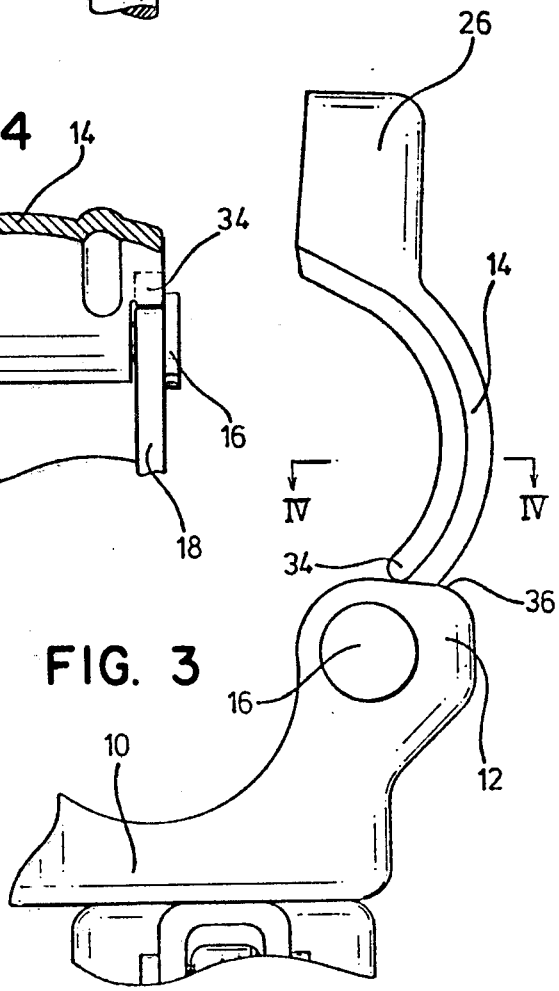
FIG. 3 is a lateral view of the clamp with the pipe holder in the opened position.

As best shown in FIGS. 3 and 4, the opposite sides of the pipe holder 14 are somewhat extended outwardly to provide stepped portions 34, 34 which are engaged when the pipe holder 14 is turned to open with the end portions 36, 36 of the pipe carrier 10 thereby sustaining the pipe holder 14 at generally a right angle to the lower section of the pipe carrier 10 as shown in FIG. 3. This structure is very convenient for temporarily supporting the pipe 30 when the pipes are combined to build up the scaffolding or the temporary building, because the pipe holder free of such stepped engaging portions will be hanged down against the pivot pin 16 and in that case the operation is required to place the pipe directly on the pipe carrier 10 and to raise the pipe holder 14 simultaneously in order to prevent the pipe slipping off the pipe carrier 10.

Figure 5:
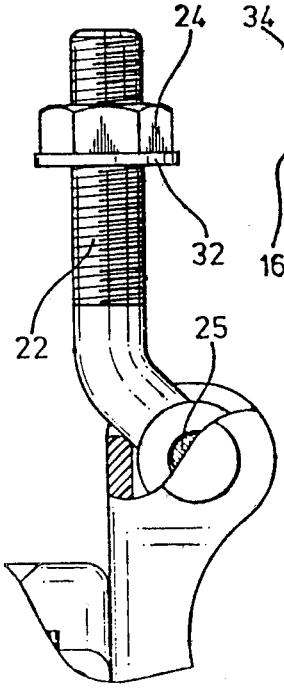
FIG. 5 is a fragmentarily enlarged lateral view of the bolt in the upstanding position.

In FIG. 5, the bolt 22 is curved at its lower portion against an axis of the pivot pin 25 so that a vertical axis of the bolt 22 is deflected and separated from the horizontal axis of the pivot 25. By this structure, the bolt 22 when turned to the upstanding position may be maintained stationarily and perpendicularly without falling down as shown in FIG. 1 because its center of gravity holds the pivot 25 at a stop position. This arrangement is also convenient for the building operation with pipes in cooperation of the capability of maintaining the pipe holder in the horizontal position as hereinbefore described.

Figure 6:
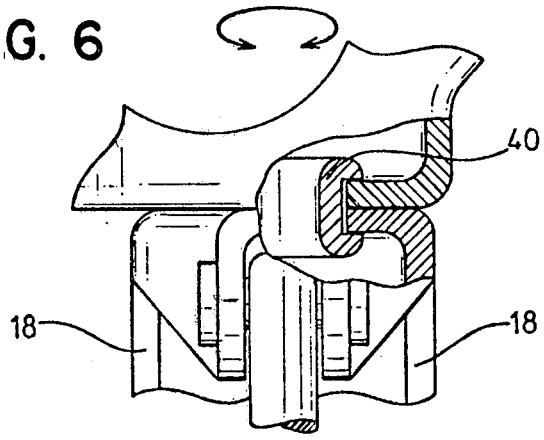
FIG. 6 is a fragmentarily enlarged sectional view of a swivel means for swivelly coupling two clamps according to the invention.

The fittings or clamps according to the invention may be associated together as shown in FIGS. 1, 2 and 6. In FIG. 1, two clamps are connected fixedly through two or more rivets 38. The combined clamps of this type may be typically used in the normally crossing portions of the pipes. While in FIG. 6, two clamps are swivelly jointed through a coupling 40. The joined clamps of this type may be used in the places where the pipes to be coupled are crossed irregularly.

In assembling the scaffolding for example by combining the vertical pipe with the horizontal pipe in use of the metal clamp according to the invention, the pipe 30 is at first placed on the pipe holder 14 in the opened position as shown in FIG. 1 and then the pipe 14 is moved onto the pipe carrier 10 by raising the pipe holder 30 against the pipe carrier 10. After the pipe 30 is completely embraced between the pipe carrier 10 and the pipe holder 14, the bolt 22 with the nut 24 is fallen down into the recess 28 provided in the embracer 26 of the pipe holder 14 for subsequent fastening operation with the nut 24.

As hereinbefore fully described, the metal clamp according to the invention may be applied to the pipes of different sizes or diameters and this enables to decrease the types of the clamps with reduction of production of the fittings and thus to minimize the space for storing the fittings.

Further, since the bolt embracer is directed to the radial direction of the circle formed by the pipe carrier and the pipe holder, the bolt does not slip off the embracer even the nut is somewhat relaxed.

Thus, the metal clamp according to the invention ensures a safe and fixed fitting effect of the clamp.

Without further elaboration, the foregoing will so fully illustrate my invention that others may, by applying the current or future knowledge, readily adapt the same for use under various conditions of service.

What is claimed is:

1. A clamp for pipes and similarly acting fittings, the clamp comprising a pipe carrier movably supporting a bolt and a pipe holder having an embracer for receiving the bolt and hinged to the pipe carrier, the pipe holder and pipe carrier when closed together defining a generally circular opening in which a pipe is supported, said clamp being characterized in that said pipe holder is provided at its one end abutting said pipe carrier with a stopper means for sustaining said pipe holder at approximately a right angle to said pipe carrier to maintain the clamp open, and at its opposite end with said embracer for receiving and fixing the bolt, said embracer being directed in a radial direction of the circular opening, and said pipe carrier and the pipe holder having pipe-support, curved surfaces of different radii of curvature, whereby the clamp can supportably receive pipes of differing diameters.

2. A clamp for pipe and similarly acting fittings as claimed in claim 1, wherein the stopper means comprises the stepped portions provided at opposite sides of the holder body for engagement with the end portion of the pipe carrier when the pipe holder is turned to the position substantially horizontal to the bottom section of the pipe carrier.

3. A clamping arrangement for pipes and similarly acting fittings comprising at least two clamps according to claim 2, further including means for coupling said two clamps integrally together.

4. A clamping arrangement for pipes and similarly acting fittings comprising at least two clamps according to claim 2, further including swivel means for movably coupling said two clamps together.

5. A clamp for pipes and similarly acting fittings according to claim 1, wherein the bolt embracer is provided with a recess into which the bolt is received.

6. A clamping arrangement for pipes and similarly acting fittings comprising at least two clamps according to claim 5, further including means for coupling said two clamps integrally together.

7. A clamping arrangement for pipes and similarly acting fittings comprising at least two clamps according to claim 5, further including swivel means for movably coupling said two clamps together.

8. A clamp for pipes and similarly acting fittings according to claim 1, wherein the radii of curvature of said pipe-support, curved surfaces of said pipe carrier and said pipe holder are determined at a substantially intermediate value among two or more pipes of different diameters.

9. A clamping arrangement for pipes and similarly acting fittings comprising at least two clamps according to claim 8, further including means for coupling said two clamps integrally together.

10. A clamping arrangement for pipes and similarly acting fittings comprising at least two clamps according to claim 8, further including swivel means for movably coupling said two clamps together.

11. A clamp for pipes and similarly acting fittings according to claim 1, wherein said pipe-support, curved surface of said pipe holder has the curvature equivalent to the curvature of a pipe of given diameter whereas said pipe-support, curved surface of said pipe carrier has the curvature equivalent to the curvature of a pipe of larger diameter than said given diameter.

12. A clamping arrangement for pipes and similarly acting fittings comprising at least two clamps according to claim 11, further including means for coupling said two clamps integrally together.

13. A clamping for pipes and similarly acting fittings comprising at least two clamps according to claim 11, further including swivel means for movably coupling said two clamps together.

14. A clamp for pipes and similarly acting fittings according to claim 1, wherein said pipe-support, curved surface of said pipe holder has the curvature equivalent to the curvature of a pipe of given diameter whereas said pipe-support, curved surface of said pipe carrier has the curvature equivalent to the curvature of the pipe of smaller diameter than said given diameter.

15. A clamping arrangement for pipes and similarly acting fittings comprising at least two clamps according to claim 14, further including means for coupling said two clamps integrally together.

16. A clamping arrangement for pipes and similarly acting fittings comprising at least two clamps according to claim 14, further including swivel means for movably coupling said two clamps together.

17. A clamp for pipes and similarly acting fittings according to claim 1, wherein a vertical axis of the bolt is deflected from a horizontal axis of a pivot pin to which an end of the bolt is journaled.

18. A clamping arrangement for pipes and similarly acting fittings comprising at least two clamps according to claim 17, further including means for coupling said two clamps integrally together.

19. A clamping arrangement for pipes and similarly acting fittings comprising at least two clamps according to claim 17, further including swivel means for movably coupling said two clamps together.

20. A clamping arrangement for pipes and similarly acting fittings comprising at least two clamps according to claim 1, further including means for coupling said two clamps integrally together.

21. A clamping arrangement for pipes and similarly acting fittings comprising at least two clamps according to claim 1, further including swivel means for movably coupling said two clamps together.

* * * * *